United States Patent [19]

Hill et al.

[11] Patent Number: 4,930,267

[45] Date of Patent: Jun. 5, 1990

[54] SANDING RASP

[75] Inventors: Douglas B. Hill, Marietta; Fredrick J. Newell, Jr., Norcross, both of Ga.

[73] Assignee: Demand Products, Inc., Smyrna, Ga.

[21] Appl. No.: 347,346

[22] Filed: May 4, 1989

[51] Int. Cl.[5] ..... B24D 15/00

[52] U.S. Cl. ..... 51/392; 51/393; 51/180

[58] Field of Search ..... 51/392, 391, 389, 358, 51/170 R, 170 MT, 393, 170 TL, 180

[56] References Cited

U.S. PATENT DOCUMENTS 2,663,979 12/1953 Sierchio ..... 51/393
4,631,220 12/1986 Clifton ..... 51/358
4,802,310 2/1989 Holmes ..... 51/170 MT

FOREIGN PATENT DOCUMENTS 289335 4/1928 United Kingdom ..... 51/389

OTHER PUBLICATIONS

Grinding, Norton Company, 1922.

*Primary Examiner*—Frederick R. Schmidt
*Assistant Examiner*—M. Rachuba
*Attorney, Agent, or Firm*—Hurt, Richardson, Garner, Todd & Cadenhead

[57] ABSTRACT

A sanding rasp designed to permit the user to readily change the sanding element. The rasp includes a heavy grit sandpaper immovably attached to a substrate which is adapted to be releasably secured to the rasp's support plate. A vibrational sander can be included as handle means.

6 Claims, 1 Drawing Sheet

SANDING RASP

BACKGROUND OF THE INVENTION

1. Field of the Invention

This invention relates to a sanding rasp, and is more particularly concerned with a hand-held sanding rasp designed to permit the user to readily change the sanding element. The rasp includes a heavy grit sandpaper immovably attached to a substrate which is adapted to be releasably secured to the rasp's support plate.

2. Description of the Prior Art

Recently, the utilization of coated, expanded polystyrene in exterior wall construction has become widely used. The process of assemblying such an exterior wall includes mounting sheets of expanded polystyrene (EPS), typically sized in 4'×8' sheets, to a support grid. The EPS sheets are placed along the support grid, with each of their respective edges abutting, so that the exterior wall includes a system of EPS panels arranged with no spaces or cracks between the abutting edges. Aligning each abutting edge, therefore, is a joint. After the joints of the EPS panels are prepared, as is discussed hereinafter, the system of EPS panels are then sprayed with a polymer modified cementitious coating having an acrylic polymer finish. As this coating cures, it is worked to the desired finish and allowed to set. Exterior wall systems of this type are becoming increasingly popular because of their low expense of erection, durability, and appearance.

A critical preparatory step in achieving a desirable final product in terms of appearance and durability, is the proper preparation of the joints between each EPS panel prior to applying the polymer coating. Practically, when the EPS panels are attached to the support grid, the joints between the panels are uneven, or are not flush. In other words, there is often a ridge along the joint line where the respective panels abut, because of variations in the support grid or the attachment of the EPS Panels to the support grid. This necessitates that the joints be properly prepared prior to the application of the polymer coating, so that the joints are smooth. In preparing the joints, the abutting panels are "blended" by sanding the area of the abutting panels around the joints, so that the panels slope gradually toward the joint, avoiding any abrupt indentations. If the joints are not carefully prepared in this manner, the final finish after the coating is applied may be greatly inundated, thus adversely affecting appearance and durability.

The preparation of the joints is a labor intensive process, because this preparation must be carefully performed. The preparation of the joints is rendered even more labor intensive, however, because of the inadequacies of the tools presently used by the industry to prepare the joints. Because of the physical properties of expanded polystyrene, the medium used to sand the EPS must be very coarse. Typically, a coarse sandpaper, such as 12 to 16 grit paper is used. Additionally, the physical properties of the EPS panels require that the sandpaper be immovably mounted to a sanding apparatus when the EPS panels are sanded. This is because if the sandpaper moves on the sanding apparatus, even to a small extent, a large indentation may be unintentionally cut into the EPS panels, requiring that the panel be replaced and the respective joint be prepared a second time. Because of this fact, those in the trade are presently cementing, by permanent epoxy, the heavy grit sandpaper to the bottom of boards, or sometimes to an aluminum apparatus resembling a cement float. The sandpaper is glued to the bottom of the sanding apparatus, because those in the construction industry realize that the paper cannot be wrapped around the apparatus and secured along the top, as has been previously done in common sanding rasps. This is because this method of securing the paper to the rasp inevitably permits the sandpaper to move or shift on the rasp, either immediately or after it is applied to the rasp or soon thereafter as the integrity of the sandpaper deteriorates by use. Therefore, the industry is solving this problem currently, by gluing the sandpaper to the sanding apparatus to ensure that the paper does not slip or move.

The use of this presently used apparatus, however, has numerous inherent disadvantages. The first is that because the sandpaper is securely cemented or epoxied to the sanding apparatus, the sandpaper cannot be readily removed when the paper is worn to a nonusable extent. Presently, the industry is soaking the sanding apparatus in strong chemical solutions in order to soften the epoxy Then the chemically treated sandpaper is scraped off of the sanding apparatus. The apparatus is then allowed to dry, and a new sheet of sandpaper is immovably cemented or epoxied thereon. This procedure is time consuming, messy, and inefficient. Also, those preparing the joints using this present apparatus, are continuing to use sandpaper past the point when the paper retains an accePtable amount of abrasive medium, because the user does not want to stop the preparation and proceed with the time consuming process of removing the epoxied sandpaper from the sanding apparatus. This is further causing problems in joint preparation.

The present invention overcomes the problems encountered by the prior-used methods, and allows the sandpaper to be not only immovably fixed to the sanding rasp, but also to be readily removed and replaced, as needed, quickly and efficiently.

SUMMARY OF THE INVENTION

Briefly described, the present invention includes a sanding rasp having a support means comprised of a handle for grasping the rasp and a support Plate attached to the handle which defines the surface area of support for an abrasion means. Releasably attached to the support plate is a replacement substrate which can be discarded after use. The substrate is preferably rigid and has attached along its lower surface a heavy grit sandpaper designed for sanding the EPS panels. The sandpaper is permanently secured to the substrate so that absolutely no movement of the sandpaper on the substrate can occur. The substrate is substantially of the same surface area as that of the support plate. The support plate includes mounting means to allow releasable attachment of the rigid substrate to the support plate. The substrate includes notches along opposed edge portions, which communicate with the mounting means attached to the support plate, in order to permit the substrate to be easily removed from and installed onto the support plate.

The sanding rasp should be of a dimension that allows efficient blending of abutting EPS panels. It has been found that a rasp having a support plate and abrasion means of approximately 14 inches long is desirable in the blending operation. The width of the sanding rasps can vary from 2 inches to 8 inches, the more narrow rasps being used for "tight" areas such as behind doors and behind shutters. The wider rasps are utilized to blend long joints in open areas, such as open wall surfaces. It has been found that in order to make the sanding rasp lightweight as well as durable, the support plate is ideally constructed of ⅛' thick polyvinyl chloride (PVC) material, and the substrate is made of approximately 1/16' PVC material. This material is readily cut to the desired shapes and is relatively inexpensive.

The rasp of the present invention, utilizing a prepared replacement substrate or plate, requires neither gluing nor timely sandpaper removal by the user, such as required by the prior art devices. Further, because the replacement substrate is easily removed and installed, it encourages the user to install a new, abrasive substrate when needed, thus avoiding the problem of the user continuing to use overworn sandpaper.

In another embodiment, an electric powered, vibrational sander is affixed to a support plate having releasable mounting means, as discussed above. A rigid substrate carrying a heavy grit sandpaper is removably attached to the support plate of the electric sanding rasp. Preferably, for use in blending EPS panels, the electric, vibrating sander should be designed so that the sander achieves a fine vibration, as opposed to a very coarse vibration. This ensures that the EPS panels will less likely be damaged by a coarse vibration during the sanding process.

Accordingly, it is an object of the present invention to provide a sanding rasp which is efficient in operation, easily maintained, inexpensive to manufacture, and durable in structure.

Another object of the present invention is to provide a sanding rasp specifically designed for blending abutting, expanded polystyrene panels.

Another object of the present invention is to provide a sanding rasp including a substrate on which the sandpaper is permanently secured, so as to be immovable thereon.

Another object of the present invention is to provide a sanding rasp in which the abrasion member can be easily installed and removed as needed.

Another object of the present invention is to provide a sanding rasp which is lightweight and durable in structure, and which includes a disposable abrasion member.

Another object of the present invention is to provide a sanding rasp which includes releasable mounting means to securely mount the abrasion member.

Another object of the present invention is to provide a sanding rasp which includes an electric vibrating sander having a disposable abrasion means attached thereto.

Other objects, features and advantages of the present invention will become apparent from the following description when taken in conjunction with the accompanying drawings wherein like characters of reference designate corresponding parts throughout the several views.

DESCRIPTION OF THE PREFERRED EMBODIMENTS

Figures 1, 2:
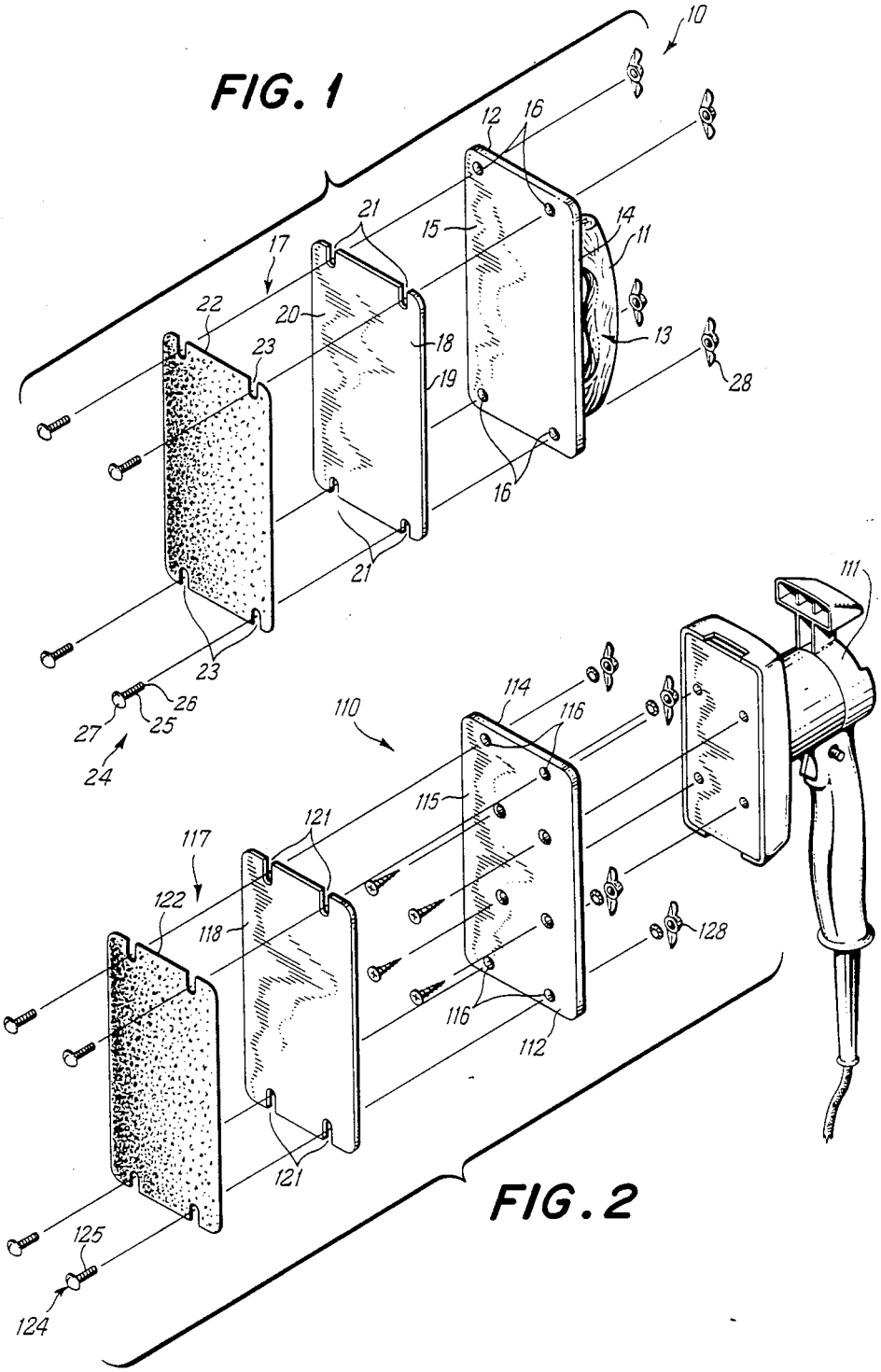
FIG. 1 is an exploded, perspective view of a sanding rasp of the present invention.
FIG. 2 is an exploded, perspective view of another embodiment of the sanding rasp.

Referring now in detail to the embodiments chosen for illustrating the resent invention, FIG. 1 depicts a sanding rasp 10 having an inverted, U-shaped, handle 11 which is securely mounted to a flat, planar, support plate 12. Support plate 12 includes upper or first surface 14 and lower, support surface 15. The handle 11 is securely mounted to the upper surface 14 of plate 12. The handle 11 and support plate 12 therefore define aperture 13 therebetween for allowing a user to grasp handle 11. Support plate 12 is preferably a rigid plate which will not bend to any extent, and can be made of steel or aluminum, but is preferably made of a more large enough to provide entire support for the remaining elements of the sanding rasp. Support plate 12 defines therethrough in the proximity of its corner areas, apertures 16.

Disposable abrasion assembly 17 is adapted to be releasably attached to lower, support surface 15 of support plate 12. Abrasion assembly 17 includes a flat, planar, rigid substrate 18 having a first or upper surface 19 and a second or lower surface 20. Defined through substrate 18, at the approximate position of its four corners, are notches 21. Substrate 18 is of approximately the same width and length as that of support plate 12, and notches 21 are therefore in alignment with aperture 16. Assembly 17 further includes a sheet of sandpaper 22 permanently affixed by, for example epoxying, to lower surface 20 of substrate 18. It is important for this invention that sandpaper 22 be affixed onto surface 20 of substrate 18 so as to be totally immovable thereon. In this sense, sandpaper 22 should be considered permanently attached to substrate 18. For the purposes of sanding EPS material, sandpaper 22 should be of a heavy grit, such as 12 to 16 grit sandpaper. The width and length of sandpaper 22 should be identical to the width and length of substrate 18. Furthermore, sandpaper 22 should define notches 23 therein, at the exact positions as notches 21 defined in substrate 18, so that when sandpaper 22 is applied to substrate 18, notches 21 and 23 are in exact alignment. Alternatively, sandpaper 22 could include apertures in the place of notches 23, which apertures align with notches 21 and apertures 16 when, of course, assembly 17 is mounted to plate 12.

Abrasion assembly 17 is releasably mounted to surface 15 of support plate 12 by mounting means 24. Mounting means 24 include bolts 25 having externally threaded shanks 26 and heads 27. Wing nuts 28 are threaded on shanks 26 to complete mounting means 24. Assembly 17 is mounted to suPPort plate 12 by passing shanks 26 through notches 23 and 21 and thereafter through apertures 16. As wing nuts 28 are tightened onto shanks 26, heads 27 securely affix assembly 17 onto plate 12 so that assembly 17 is immovable with plate 12. In this fashion, it is obvious that assembly 17 can be easily removed or replaced by loosening mounting means 24 and inserting another abrasion assembly 17.

The rasps can be of various sizes and shapes, however, it is found that in blending abutting panels of EPS material, as previously discussed, the sanding rasp should be approximately 14 inches long and can be from 2 to 8 inches wide, depending upon the application.

In another embodiment of the present invention, the sanding rasp 110 includes a handle means 111 in the form of a vibrating sander. Such a vibrating sander 111, is of a common vibrating sander well known in the art. However, for the purposes of applying the sander to blending abutting EPS panels, as previously discussed, the sander should be of a type which allows a fine oscillation or vibration. This will ensure that the sanding of the EPS material will be less likely to make undesired indentations in the EPS material. A support plate 112 is secured to handle means or sander 111. The support plate 112 includes upper surface 114 and lower or support surface 115, and defines apertures 116 along its outer surface in the approximate positions of its edges. As in the previous embodiment, an abrasion assembly 117 is provided, which includes substrate 118 defining notches 121 therein. Sandpaper 122 is securely mounted to substrate 118 so as to be permanently affixed and immovably attached thereto. As also in the previous embodiments, abrasion assembly 117 is releasably attached to support plate 112 by releasable mounting means 124. The advantages of sanding rasp 112 are identical to those as discussed with respect to the previous embodiment, that is the abrasion assembly 117 can be easily and readily removed from and attached to support plate 112, as necessary. The only difference in the embodiments 10 and 110 is that embodiment 110 includes an electric sanding means 111 as a handle.

It will further be obvious to those skilled in the art that many variations may be made in the above embodiments here chosen for the purpose of illustrating the present invention, and full result may be had to the doctrine of equivalents without departing from the scope of the present invention, as defined by the appended claims.

What is claimed is:

1. A sanding rasp for sanding abutting, expanded polystyrene building panels which are arranged to define a building surface, comprising:

(a) a handle means for grasping said rasp;

(b) a support plate having a flat lower surface, secured to said handle means;

(c) a rigid substrate having a first surface and a second surface, releasable mounted along its first surface to the lower surface of said support plate wherein said substrate defines notches alone one or more of its edges for communicating with said mounting means;

(d) sandpaper attached to the second surface of said substrate, whereby said sandpaper is immovable on said substrate when said sanding rasp is used for sanding said building surface; and (e) mounting means attached to said support plate for releasably mounting said substrate to said support plate, whereby said substrate can be readily removed and installed onto said support plate.

2. The sanding rasp defined in claim 1, wherein said sandpaper is of a heavy grit type.

3. The sanding rasp defined in claim 1, wherein said support plate defines an aperture therethrough for receiving said mounting means.

4. The sanding rasp defined in claim 1, wherein said mounting means includes an externally threaded bolt having a head and a shank, and a wing nut for being received on said shank.

5. The sanding rasp defined in claim 4, wherein said substrate includes notches along one or more of its edges, and wherein said support plate defines apertures therethrough, each of said apertures being in alignment with a respective said notch, when said substrate is properly positioned attached onto said support plate, whereby said shank passes through one of said notches of said substrate and through said aperture of said support plate aligned with said notch, and whereby the threading of said wing nut into said shank causes said substrate to be compressed between the head of said bolt and said support plate for releasable attachment of said substrate to said support plate.

6. The sanding rasp defined in claim 1, wherein said handle means includes an electric vibrational sander.

* * * * *

UNITED STATES PATENT AND TRADEMARK OFFICE

CERTIFICATE OF CORRECTION

PATENT NO. : 4,930,267

DATED : June 5. 1990

INVENTOR(S) : Hill, et al.

It is certified that error appears in the above—identified patent and that said Letters Patent is hereby corrected as shown below:

Column 5, line 35, cancel "releasable" and insert --releasably--;

Column 5, line 36, cancel "wherein said";

Column 6, lines 1-3, cancel "substrate defines notches alone one or more of its edges for communicating with said mounting means--;

Column 6, line 11, after "plate" insert --and wherein said substrate defines notches along one or more of its edges for communicating with said mounting means--;

UNITED STATES PATENT AND TRADEMARK OFFICE

CERTIFICATE OF CORRECTION

PATENT NO. : 4,930,267

DATED : June 5, 1990

INVENTOR(S) : Hill, et al.

It is certified that error appears in the above-identified patent and that said Letters Patent is hereby corrected as shown below:

Column 6, lines 21-25, cancel "wherein said substrate includes notches along one or more of its edges,--.

Signed and Sealed this

First Day of October, 1991

*Attest:*

*Attesting Officer*

HARRY F. MANBECK, JR.

*Commissioner of Patents and Trademarks*